US009870751B2

(12) United States Patent
Cheng

(10) Patent No.: US 9,870,751 B2
(45) Date of Patent: Jan. 16, 2018

(54) POWER SUPPLYING MODULE AND RELATED DRIVING MODULE AND ELECTRONIC DEVICE

(71) Applicant: Sitronix Technology Corp., Hsinchu County (TW)

(72) Inventor: Chia-Chi Cheng, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 14/946,728

(22) Filed: Nov. 19, 2015

(65) Prior Publication Data

US 2016/0189660 A1 Jun. 30, 2016

Related U.S. Application Data

(60) Provisional application No. 62/096,886, filed on Dec. 25, 2014.

(51) Int. Cl.
*G09G 3/00* (2006.01)
*G09G 3/36* (2006.01)

(52) U.S. Cl.
CPC ..... *G09G 3/3696* (2013.01); *G09G 3/3648* (2013.01); *G09G 2300/043* (2013.01); *G09G 2310/08* (2013.01); *G09G 2330/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,884,795 | B2 * | 2/2011 | Cho | G09G 3/20 345/100 |
| 8,558,777 | B2 * | 10/2013 | Jang | G09G 3/20 345/100 |
| 2005/0201508 | A1 * | 9/2005 | Shin | G09G 3/3677 377/10 |
| 2006/0221041 | A1 * | 10/2006 | Cho | G09G 3/20 345/100 |
| 2011/0055671 | A1 * | 3/2011 | Kim | G06F 11/1028 714/800 |
| 2011/0102416 | A1 | 5/2011 | Hung | |
| 2011/0169798 | A1 | 7/2011 | Lee | |

FOREIGN PATENT DOCUMENTS

| | | | |
|---|---|---|---|
| CN | 1637549 | A | 7/2005 |
| CN | 101197566 | A | 6/2008 |
| CN | 101739966 | A | 6/2010 |
| CN | 202268156 | U | 6/2012 |
| CN | 103854607 | A | 6/2014 |
| JP | 200757554 | A | 3/2007 |
| TW | 200614634 | A | 5/2006 |
| TW | 201117179 | A1 | 5/2011 |

* cited by examiner

*Primary Examiner* — Van Chow
(74) *Attorney, Agent, or Firm* — Winston Hsu

(57) ABSTRACT

A power supplying module for an electronic device with a display function includes a first power supplying unit, for charging an output end according to a first clock signal, wherein the output end is coupled to a driving module of the electronic device; and a clock generating unit, for adjusting the first clock signal when an event occurs to make the first power supplying unit charge the output end when the event occurs.

8 Claims, 11 Drawing Sheets

POWER SUPPLYING MODULE AND RELATED DRIVING MODULE AND ELECTRONIC DEVICE

CROSS REFERENCE TO RELATED APPLICATIONS

This application claims the benefit of U.S. Provisional Application No. 62/096,886, filed on 2014 Dec. 25, the contents of which are incorporated herein in their entirety.

BACKGROUND OF THE INVENTION

1. Field of the Invention

The present invention relates to a power supplying module and related driving module and electronic device, and more particularly, to a power supplying module capable of providing adequate driving ability when events occur and related driving module and electronic device.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, especially in the large-size LCD family. A driving system installed in the LCD, includes a timing controller, source drivers and gate drivers. The source and gate drivers respectively control data lines and scan lines, which intersect to form a cell matrix. Each intersection is a cell including crystal display molecules and a TFT. In the driving system (e.g. a driving integrated circuit (IC)), the gate drivers are responsible for transmitting scan signals to gates of TFTs to turn on the TFTs on the panel. The source drivers are responsible for converting digital image data, sent by the timing controller, into analog voltage signals and outputting the voltage signals to sources of the TFTs. When the TFT receives the voltage signals, a corresponding liquid crystal molecule has a terminal whose voltage changes to equalize the drain voltage of the TFT, and thereby changes its own twist angle. The rate that light penetrates the liquid crystal molecule is changed accordingly, and thus different colors can be displayed on the panel.

As technology advances, the resolutions of the liquid crystal display gradually increases (e.g. increases from full high definition (HD) to 4K) and the image quality of the liquid crystal display is also improved. When the resolution of the liquid crystal display increases, charging times of the driving device (e.g. a driving IC), used for driving the display panel in the liquid crystal display, charging the display components in the display panel decrease. In the other hand, the loadings of the display panel increase with the size of the display panel.

Please refer to FIG. 1, which is a schematic diagram of related signals in the conventional LCD. In FIG. 1, control signals G1-Gn are signals of scan lines in the convention LCD, a current IVGH is the current drawing from a voltage source VDD to a driving module for generating the control signals G1-Gn, and a clock signal CLK is utilized to control a power supplying module generating the voltage source VDD. For example, the power supplying module charges the voltage source VDD when the clock signal is a high logic level, to hold the voltage of the voltage source VDD to a voltage VGH. Because the scan lines are capacitive loadings, the driving module does not draw current from the voltage source VDD after the voltages of the control signals G1-Gn reaches the voltage VGH. That is, the driving module draws the current from the voltage source VDD only at times T1-Tn of increasing or decreasing the voltages of the control signals G1-Gn and the driving module does not consumes current at the time other than the times T1-Tn. However, the clock signals CLK shown in FIG. 1 utilizes contiguous pulses with fixed time intervals to control the power supplying module to charge the voltage source VDD. Even though the driving module does not consumes current at the time other than the times T1-Tn, the power supplying module still contiguously charges the voltage source VDD. The additional power is consumed, therefore. Thus, how to make the power supplying module provide the current required by the driving module and to avoid consuming additional current at the same time become a topic to be discussed.

SUMMARY OF THE INVENTION

In order to solve the above problem, the present invention provides a power supplying module capable of providing adequate driving ability when events occurs and related driving module and electronic device.

The present invention discloses a power supplying module for an electronic device with a display function. The power supply module comprises a first power supplying unit, for charging an output end according to a first clock signal, wherein the output end is coupled to a driving module of the electronic device; and a clock generating unit, for adjusting the first clock signal when an event occurs to make the first power supplying unit charge the output end when the event occurs.

The present invention further discloses a driving module for an electronic device with a display function. The driving module comprises a first power supplying unit, for charging an output end according to a first clock signal; a clock generating unit, for adjusting the first clock signal when an event occurs to make the first power supplying unit charge the output end when the event occurs; and a driving module, coupled to the output end of the first power supplying unit for driving a display module of the electronic device.

The present invention further discloses an electronic device. The electronic device comprises a display module; a power supplying module, comprising a first power supplying unit, for charging an output end according to a first clock signal; and a clock generating unit, for adjusting the first clock signal when an event occurs to make the first power supplying unit charge the output end when the event occurs; and a driving module, coupled to the output end of the first power supplying unit for driving the display module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
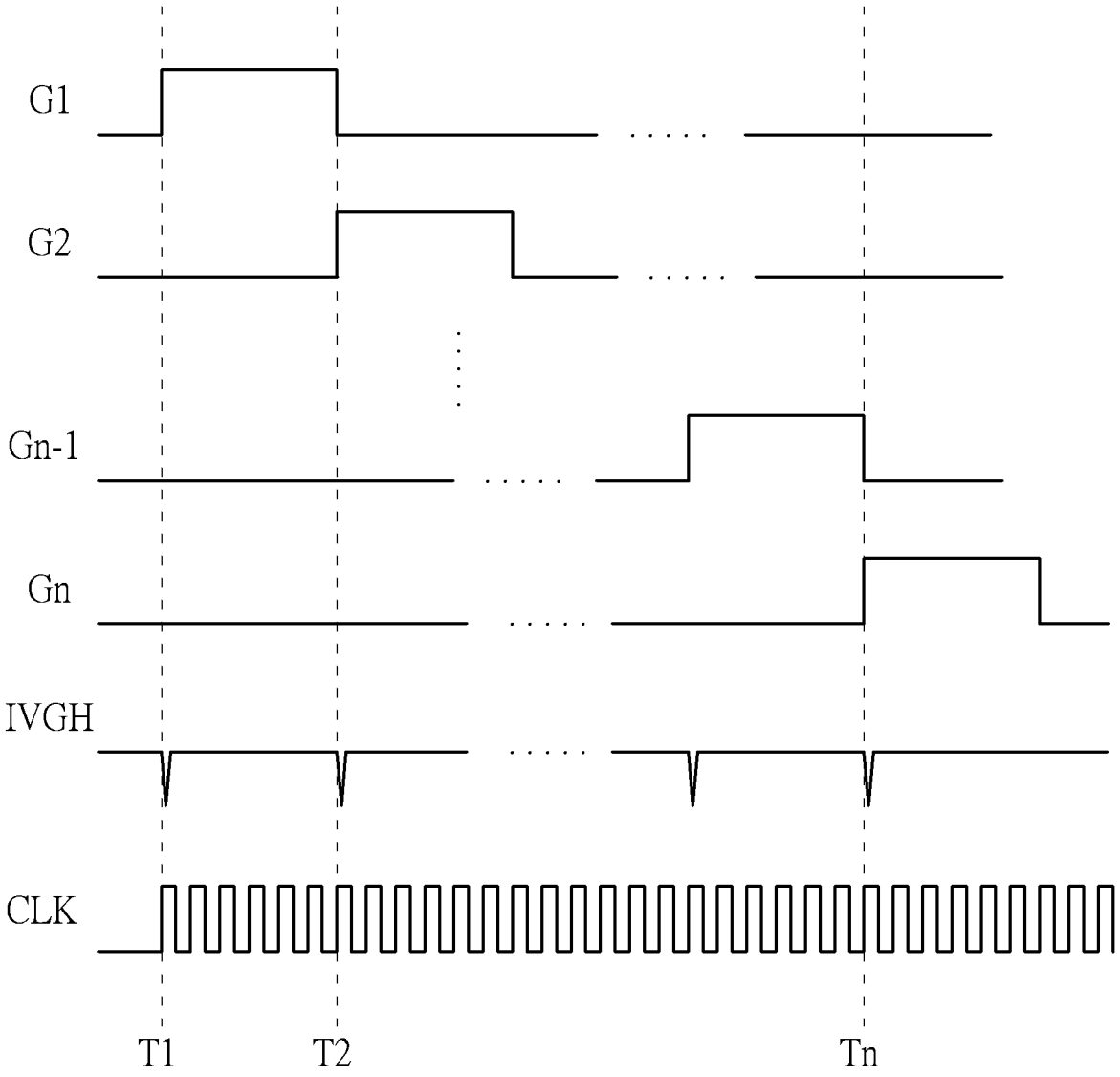
FIG. 1 PRIOR ART
FIG. 1 is a schematic diagram of related signals of the conventional liquid crystal display.
Figure 2:
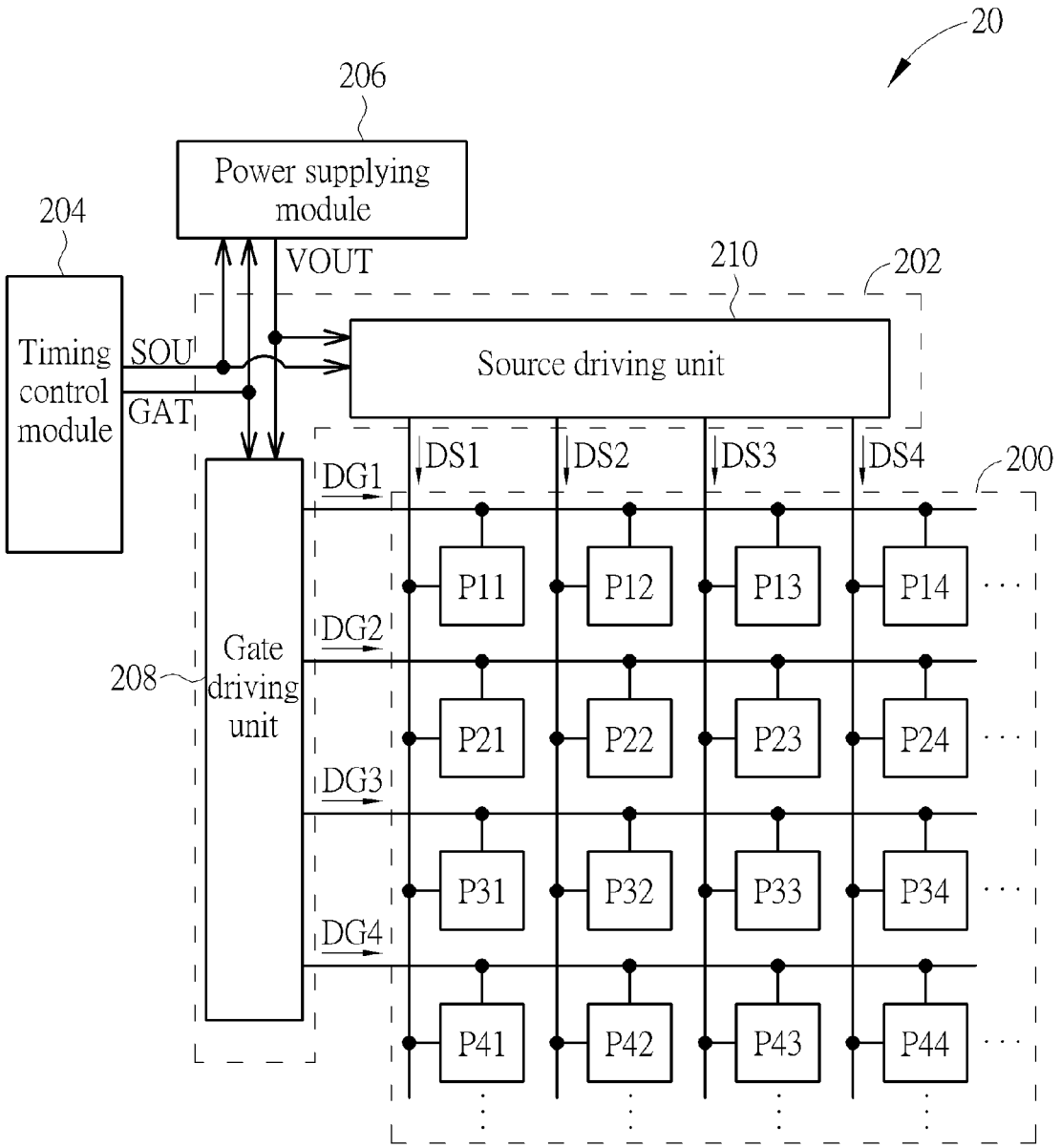
FIG. 2 is a schematic diagram of a display device according to an example of the present invention.

Please refer to FIG. 2, which is a schematic diagram of a display device 20 according to an example of the present invention. The display device 20 may be a mobile electronic device with a display panel, such as a smart phone or a table, and is not limited herein. As shown in FIG. 2, the display device 20 comprises a display module 200, a driving module 202, a timing control module 204 and a power supplying module 206. The display module 200 is a display panel and comprises pixels PIX11-PIXmn. The driving module 202 comprises a gate driving unit 208 and a source driving unit 210 and is utilized to generate driving signals DG1-DGm and DS1-DSn, which are utilized for driving the display module 200 according to control signals GAT and SOU. The timing control module 204 is utilized to generate the control signal GAT and SOU. The power supplying module 206 is utilized to provide a voltage VOUT as a voltage source of driving module 202.

Figure 3:
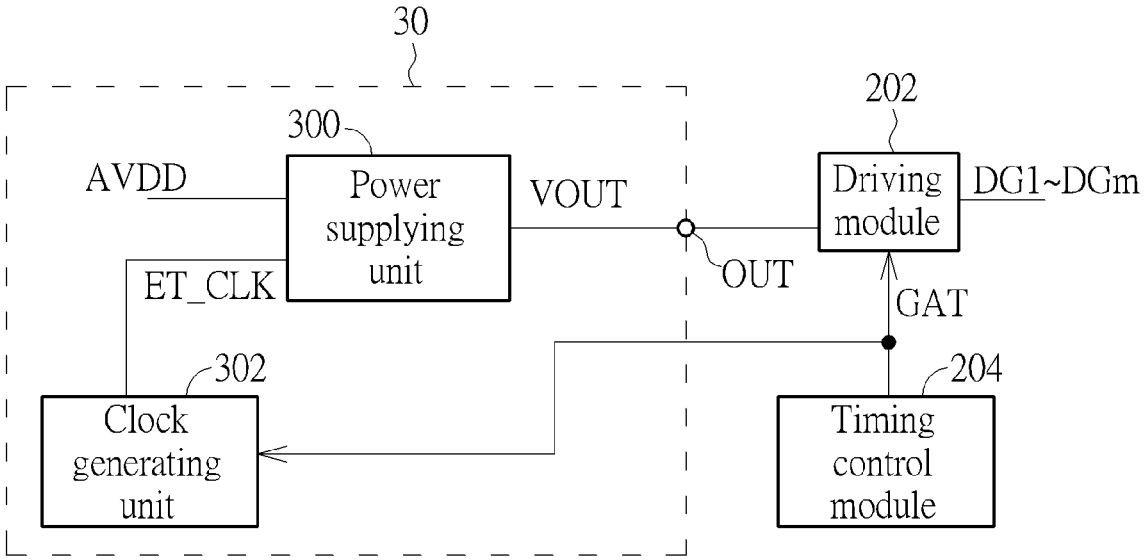
FIG. 3 is a schematic diagram of a power supplying module according to an example of the present invention.

Please refer to FIG. 3, which is a schematic diagram of a power supply module 30 according to an example of the present invention. The power supplying module 30 is an implementation of the power supplying module 206 shown in FIG. 2. In FIG. 3, the power supplying module 30 comprises a power supplying unit 300 and a clock generating unit 302. The power supplying unit 300 uses a system power AVDD to charge or to discharge an output end OUT according to a clock signal ET_CLK, to keep an output voltage VOUT of the output end OUT to a specified voltage VGH and to drive the driving module 202. In this example, the driving module 202 generates the driving signals DG1-DGm according to the control signal GAT. The clock generating unit 302 is utilized to adjust the clock signal ET_CLK when an event occurs, to make the power supplying unit 300 charge the output end OUT when the event occurs. Under such a condition, the power supplying module 30 provides adequate driving ability to the driving module 302 and the power consumption of the power supplying module 30 decreases.

In details, the driving module 202 needs to draws significant current from the output end OUT when the control signal GAT instructs the driving module 202 to adjust the driving signals DG1-DGm. If the power supplying unit 300 does not provide adequate current to the driving module 202, the driving module 202 cannot rapidly adjust the driving signals DG1-DGm to the target voltages. Thus, the clock generating unit 302 determines that the event occurs when the driving module 200 needs to draw significant current from the output end OUT, and adjusts the clock signals ET_CLK to make the power supplying unit 300 charge the output end OUT via the system power AVDD and provide the current of the driving module 202 adjusting the driving signals DG1-DGm. In other words, the clock generating unit 302 of this example adjusts the clock signal ET_CLK when the control signal GAT instructs the driving module 202 to adjust the driving signals DG1-DGm (i.e. when the event occurs), to make the power supplying unit 300 charge the output end OUT. The power supplying module 30 therefore can provide the adequate driving ability to drive the driving module 202. In addition, the power consumption of the power supplying module 30 also decreases because the power supplying unit 300 charges the output end OUT only when the event occurs.

In this example, the control signal GAT is generated by the timing control module 204. In another example, the timing control module 204 is combined with the clock generating unit 302. That is, the timing control module 204 can be omitted and the clock generating unit 302 generates the clock signal ET_CLK when adjusting the control signal GAT.

Figure 4:
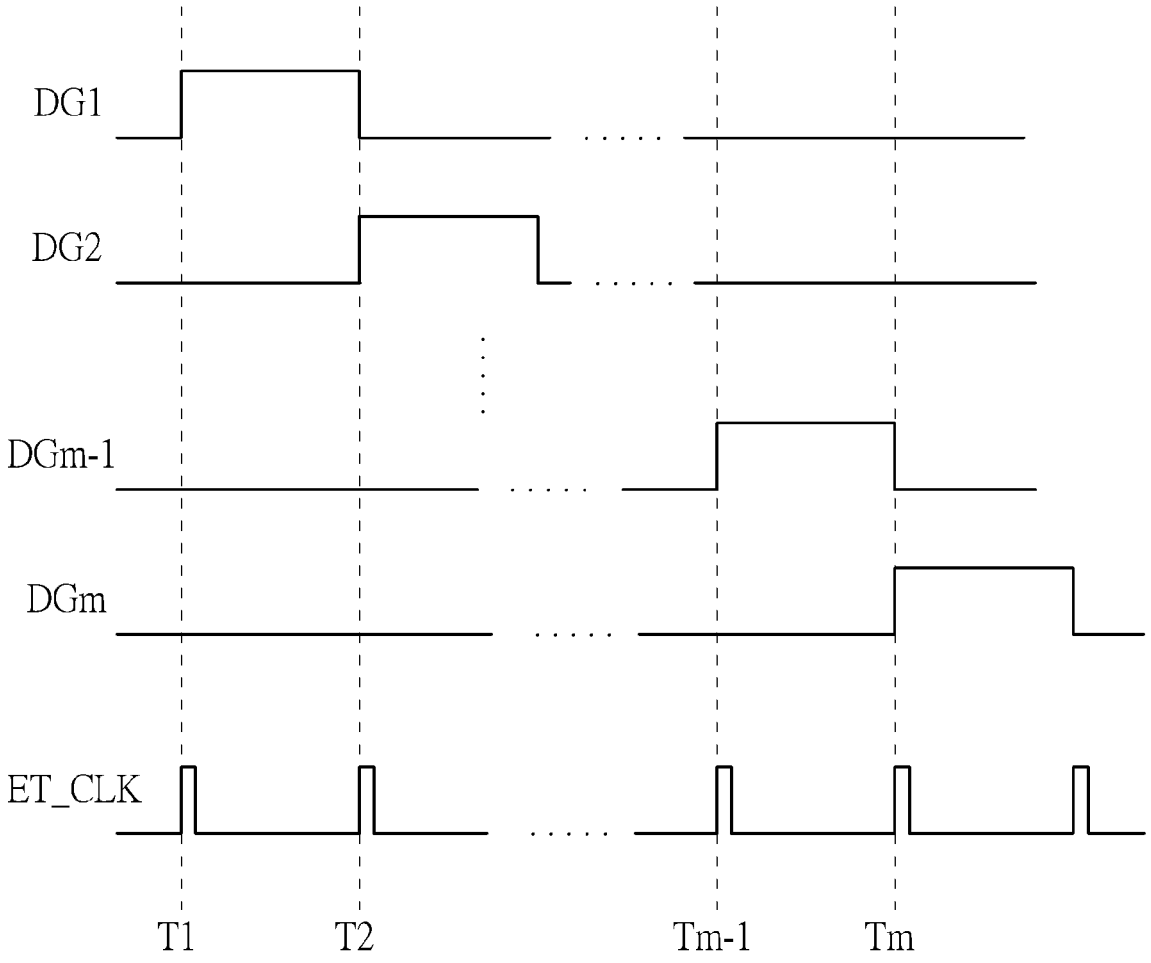
FIG. 4 is a schematic diagram of related signals of the power supplying module shown in FIG. 3.

Please refer to FIG. 4, which is a schematic diagram of related signals of the power supply module 30 shown in FIG. 3. At a time T1, the control signal GAT instructs the driving module 202 to adjust the driving signal DG1 from a low-logic level (e.g. a specified voltage VGL) to a high-logic level (e.g. the specified voltage VGH). Under such a condition, the clock generating unit 302 generates a pulse on the clock signal ET_CLK, to make the power supplying unit 300 charge the output end OUT. Similarly, the control signal GAT instructs the driving module 202 to adjust the driving signal DG1 from the high-logic level to the low-logic level and to adjust the driving signal DG2 from the low-logic level to the high-logic level at a time T2. The clock generating unit 302 generates a pulse on the clock signal ET_CLK to make the power supplying unit 300 charge the output end OUT, and so on. The power supplying module 30 therefore can provide adequate driving ability to drive the driving module 202.

Figure 5:
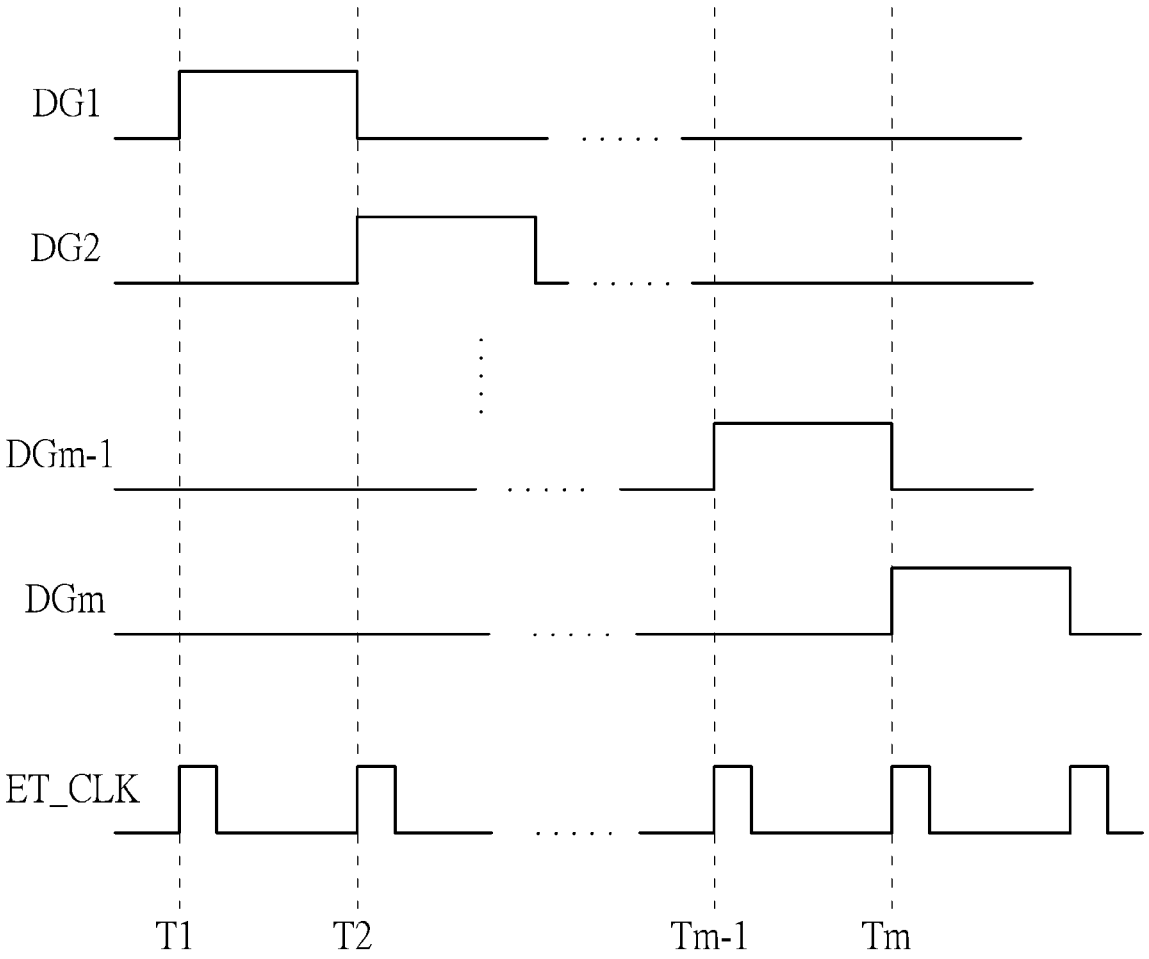
FIG. 5 is a schematic diagram of related signals of the power supplying module shown in FIG. 3.

Please refer to FIG. 5, which is a schematic diagram of related signals of the power supply module 30 shown in FIG. 3. At times T1-Tm, the control signal GAT instructs the driving module 202 to adjust the driving signals DG1-DGm and the clock generating unit 302 generate pulses on the clock signal ET_CLK to make the power supply unit 300 charge the output end OUT. Different from FIG. 4, the clock generating unit 302 enlarges the pulse widths of the pulses on the clock signal ET_CLK, to prolong the time of the power supplying unit 300 charging the output end OUT. In other words, the clock generating unit 302 may adjust the pulse widths of the pulses on the clock signal ET_CLK according to different operation conditions.

Figure 6:
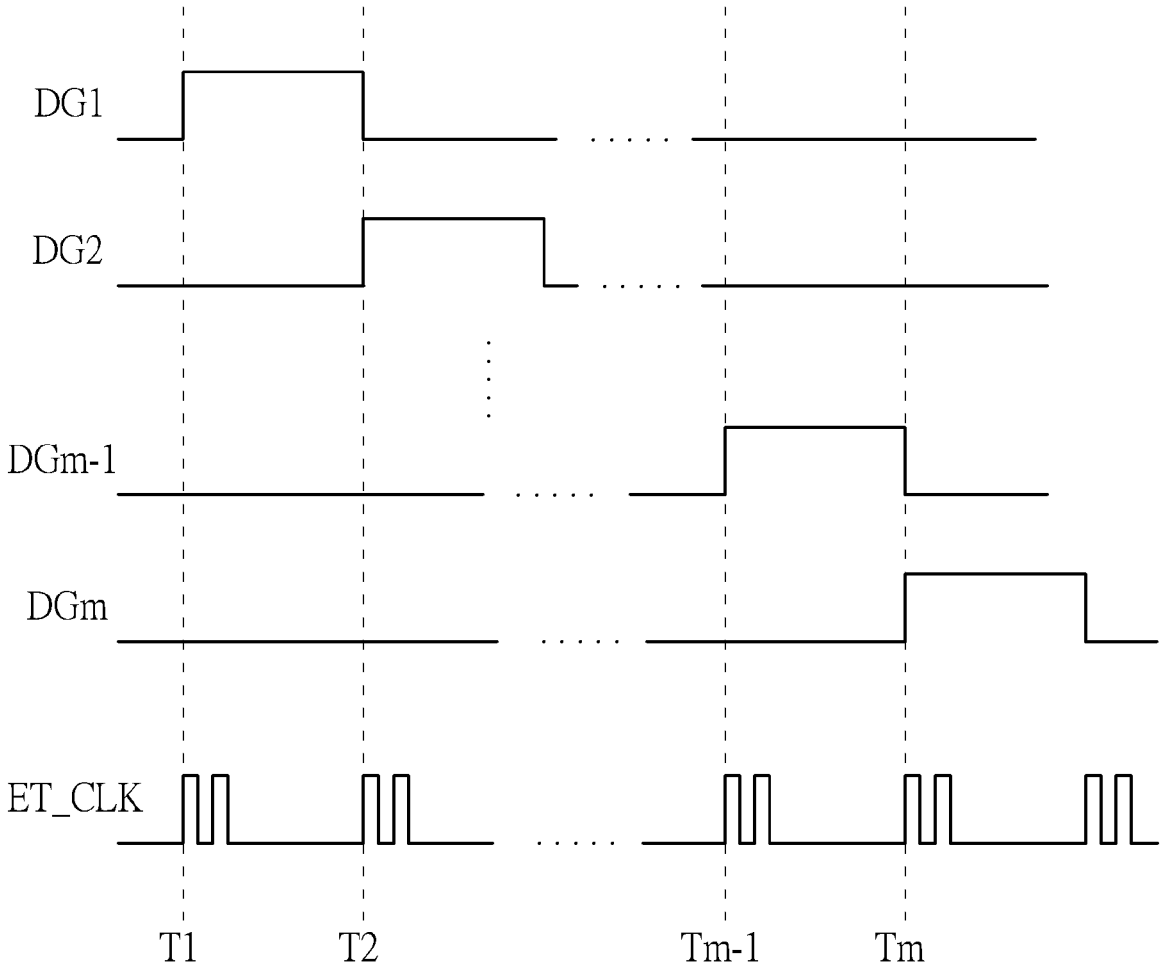
FIG. 6 is a schematic diagram of related signals of the power supplying module shown in FIG. 3.

Please refer to FIG. 6, which is a schematic diagram of related signals of the power supply module 30 shown in FIG. 3. Similarly, the control signal GAT instructs the driving module 202 to adjust the driving signals DG1-DGm and the clock generating unit 302 generate pulses on the clock signal ET_CLK to make the power supply unit 300 charge the output end OUT at times T1-Tm. Note that, the clock generating unit 302 generates 2 contiguous pulses at each of times T1-Tm in this example, to increase the number of times of the power supplying unit 300 charging the output end OUT. That is, the clock generating unit 302 may adjust the number of the pulses on the clock signal ET_CLK in response to the event according to different operation conditions.

Note that, the clock generating unit 302 may generate the clock signal ET_CLK according to the control signal SOU. When the driving module 202 adjusts the driving signals DS1-DSn, the clock generating unit 302 generates pulses on the clock signal ET_CLK, to make the power supplying unit 300 charge the output end when the driving module 202 adjusts the driving signals DS1-DSn. In another example, the clock generating unit 302 generates the clock signal ET_CLK according to both the control signals GAT and SOU.

Figure 7:
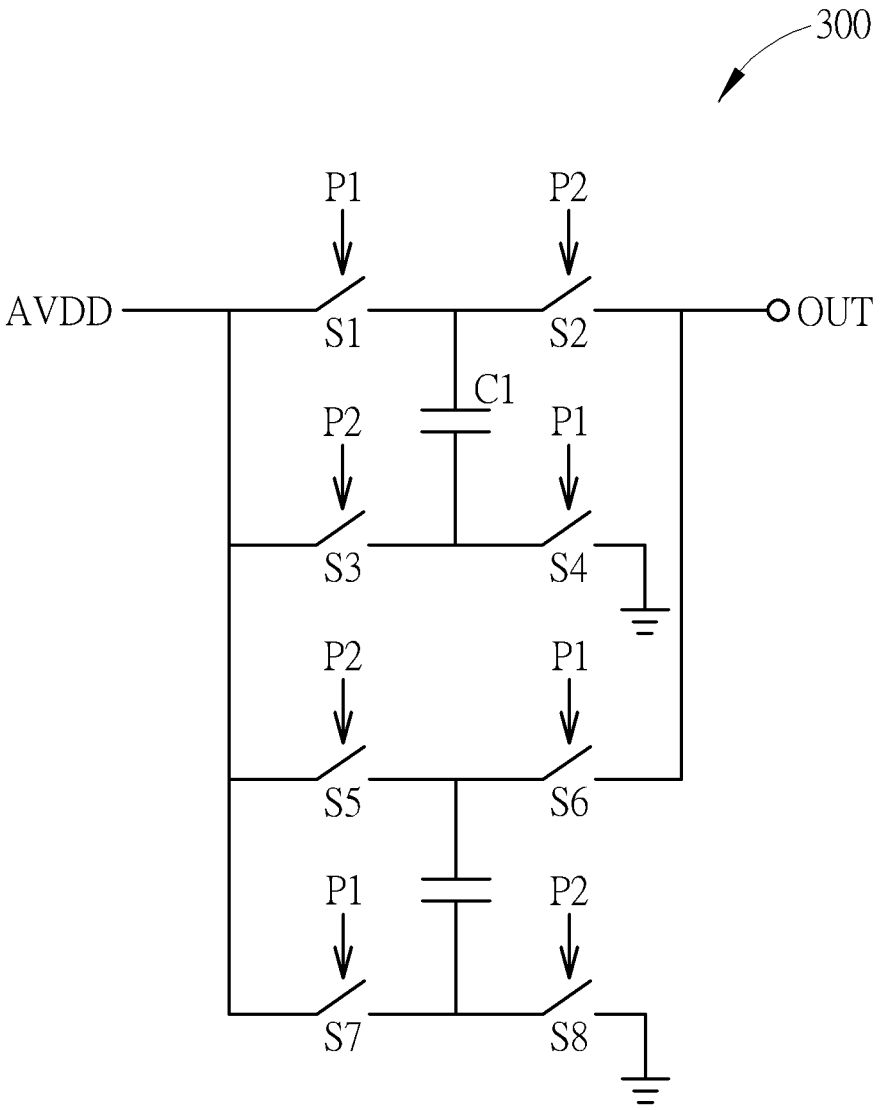
FIG. 7 is a schematic diagram of an implementation of the power supplying unit shown in FIG. 3.

According to different applications and designed concepts, the power supplying units 300 can be realized in various methods. Please refer to FIG. 7, which is a schematic diagram of an implementation of the power supplying unit 300 shown in FIG. 3. As shown in FIG. 7, the power supplying unit 300 is realized by charge pump and comprises capacitors C1, C2 and switches S1-S8, wherein the switches S1-S8 are controlled by control signals P1 and P2, respectively. When the power supplying unit 300 receives a pulse on the clock signal ET_CLK, the control signal P1 is switched to conduct the switches S1, S4, S6, and S7 and the control signal P2 is switched to disconnect the switches S2, S3, S5, and S8. The system power AVDD starts to charge the capacitor C1 and the capacitor C2 discharges current to the output end OUT. When the power supplying unit 300 receives next pulse on the clock signal ET_CLK, the control signal P1 is switched to disconnect the switches S1, S4, S6, and S7 and the control signal P2 is switched to conduct the switches S2, S3, S5, and S8. The system power AVDD changes to charge the capacitor C2 and the capacitor C1 discharges current to the output end OUT.

Figure 8:
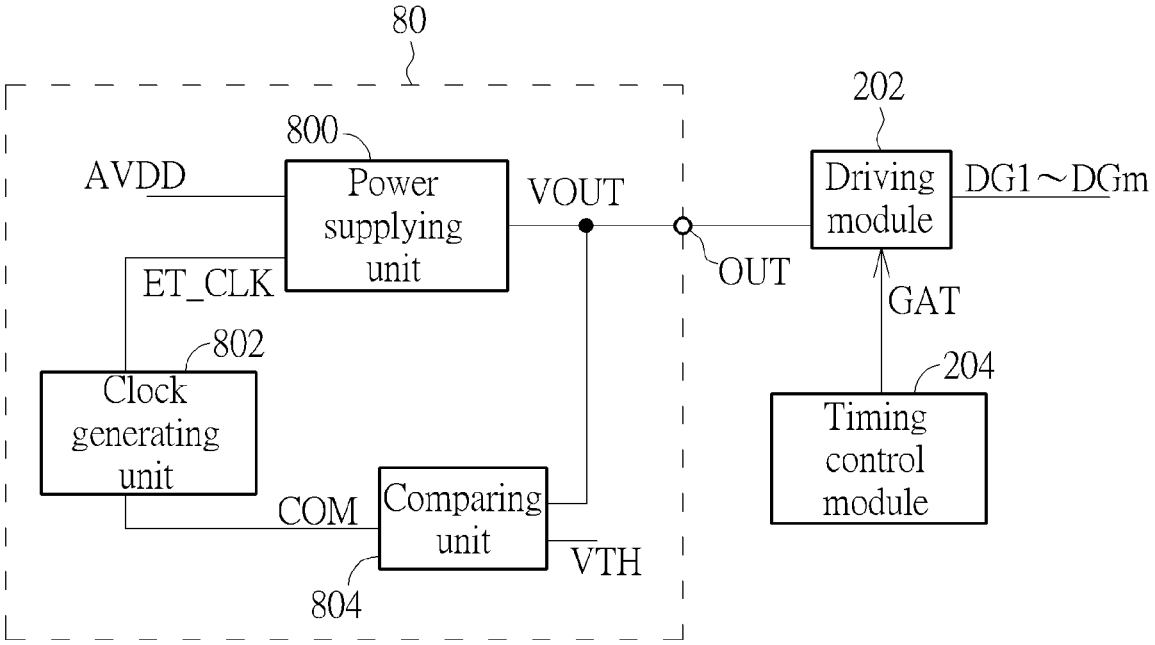
FIG. 8 is a schematic diagram of a power supplying module according to an example of the present invention.

Please refer to FIG. 8, which is a schematic diagram of a power supplying module 80 according to an example of the present invention. The power supplying module 80 is an implementation of the power supplying module 206 shown in FIG. 2. In FIG. 8, the power supplying module 80 comprises a power supplying unit 800, a clock generating unit 802 and a comparing unit 804. The power supplying module 80 shown in FIG. 8 is similar to the power supplying module 30 shown in FIG. 3, thus the components and signals with similar functions use the same symbols. In comparison with the power supplying module 30, the power supplying module 80 adds the comparing unit 804 for comparing the output voltage VOUT of the output end OUT and a threshold voltage VTH and accordingly generating a comparing signal COM to the clock generating unit 802 for indicating whether the output voltage VOUT is greater than the threshold voltage VTH. When the comparing signal COM indicates that the output voltage VOUT is smaller than the threshold voltage, the clock generating unit 802 determines the event occurs and adjusts the clock signal ET_CLK, to make the power supplying unit 800 charge the output end OUT. The power supplying module 80 therefore can provide adequate driving ability to drive the driving module 202.

Figure 9:
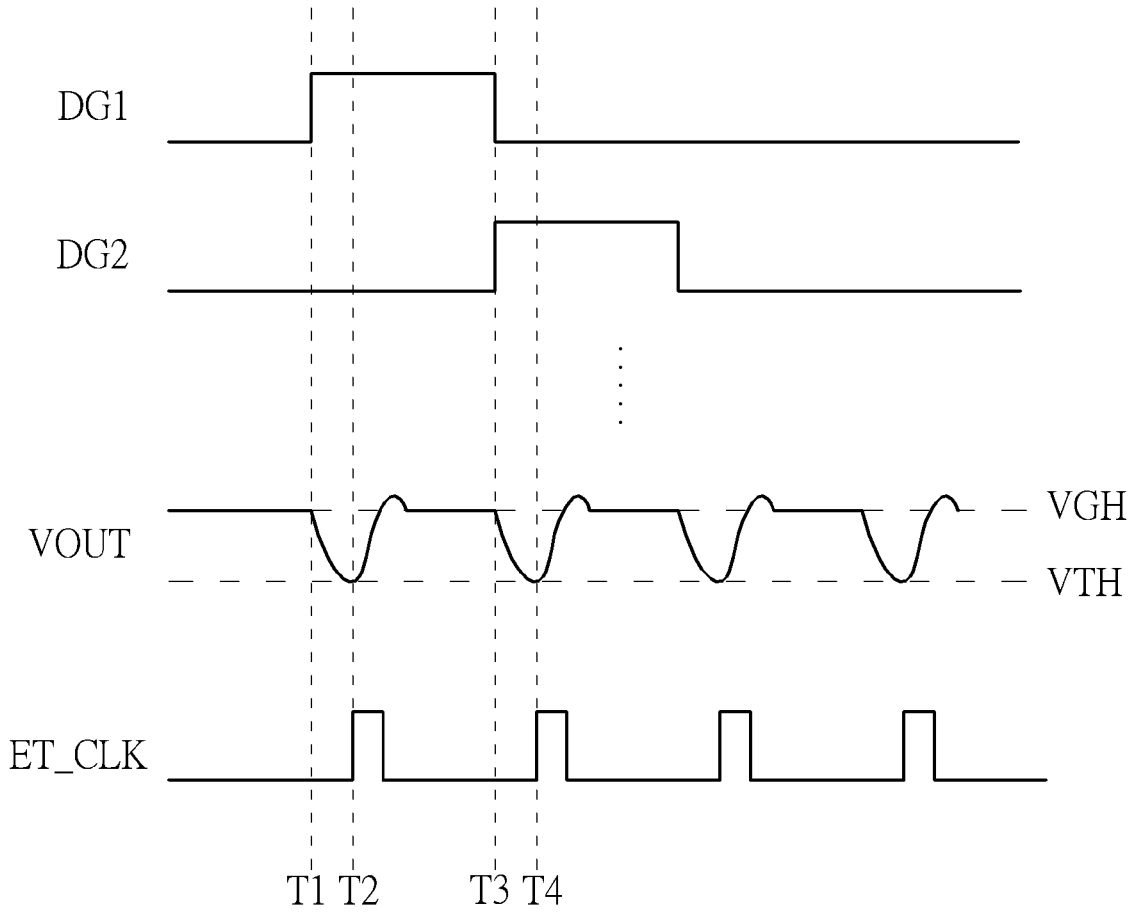
FIG. 9 is a schematic diagram of related signals of the power supplying module shown in FIG. 8.

Please refer to FIG. 9, which is a schematic diagram of related signals of the power supply module 80 shown in FIG. 8. At the time T1, the control signal GAT instructs the driving module 202 adjusts the driving signal DG1 from the low-logic level to the high-logic level, resulting that the output voltage VOUT starts decreasing from the specified voltage VGH. The output voltage VOUT becomes smaller than the threshold voltage VTH at the time T2 and the clock generating unit 802 generates a pulse on the clock signal ET_CLK, to make the power supplying unit 800 charge the output end OUT. Similarly, the control signal GAT instructs the driving module 202 to adjust the driving signal DG1 from the high-logic level to the low-logic level and to adjust the driving signal DG2 from the low-logic level to the high-logic level at a time T3, resulting that the output voltage VOUT starts decreasing. The output voltage VOUT becomes smaller than the threshold voltage VTH at the time T4 and the clock generating unit 802 generates a pulse on the clock signal ET_CLK, to make the power supplying unit 800 charge the output end OUT. The power supplying module 80 therefore can provide adequate driving ability to drive the driving module 202.

In the above examples, the power supplying module charges the output end only when determining the event occurs (e.g. when the driving module 202 draws significant current or the output voltage VOUT becomes smaller than the threshold voltage VTH). Under such a condition, the power supplying module can provide the adequate driving ability to drive the driving module 202 and the power consumption of the power supplying module also decreases. According to different applications and designed concepts, those with ordinary skill in the art may observe appropriate alternations and modifications. For example, if the clock generating unit 302 does not determine the event occurs within a specified period (e.g. the driving module 202 does not adjust the driving signals DG1-DGm and the output voltage VOUT is not smaller than the threshold voltage VTH within the specified period), the clock generating unit 302 determines the event occurs and adjusts the clock signal ET_CLK to make the power supplying unit 300 charge the output end OUT.

In addition, the power supplying module of the above examples may be configured in other circuits in the display device according different applications and designed concepts. For example, the power supplying module 206 shown in FIG. 2 may be configured in the driving module 202. In an example, the driving module 202 shown in FIG. 2 comprises the gate driving unit 208, the source driving unit 210, the power supplying unit 300, and the clock generating unit 302 when the power supplying module 206 is realized by the power supplying module 30 shown in FIG. 3.

Figure 10:
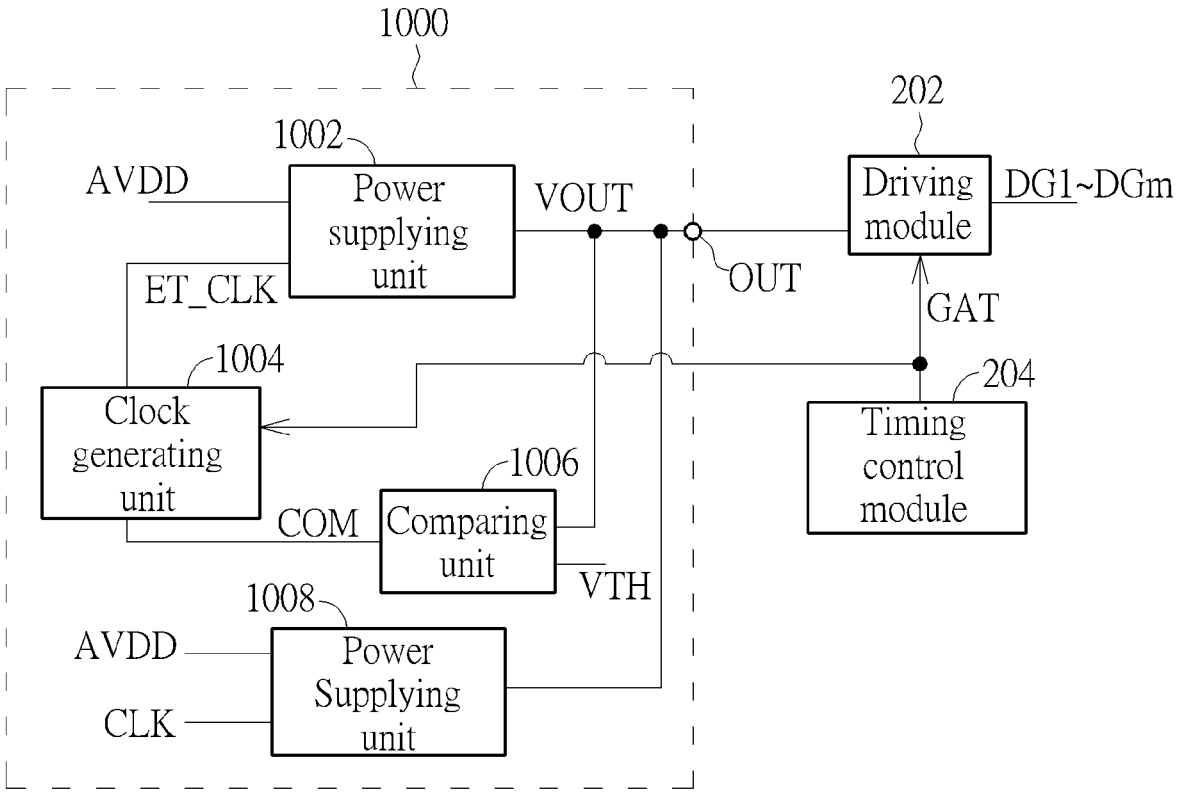
FIG. 10 is a schematic diagram of a power supplying module according to an example of the present invention.

Please refer to FIG. 10, which is a schematic diagram of a power supplying module 1000 according to an example of the present invention. Similar to the power supplying module 80 shown in FIG. 8, the power supplying module 1000 comprises a power supplying unit 1002, a clock generating unit 1004, and a comparing unit 1006. In this example, the clock generating unit 1004 adjusts the clock signal ET_CLK when the control signal GAT instructs the driving module 202 to adjust at least one of the driving signals DG1-DGm, to make the power supplying unit 1002 charge the output end OUT when the driving module 202 adjusts at least one of the driving signals DG1-DGm. In addition, the clock generating unit 1004 also adjusts the clock signal ET_CLK when the comparing signal COM indicates that the output voltage VOUT becomes smaller than the threshold voltage VTH, to make the power supplying unit 1002 charge the output end OUT. In other words, the events in this example comprise that the driving module 202 draws significant current and that the output voltage VOUT becomes smaller than the threshold voltage VTH.

Further, the power supplying module 100 adds a power supplying unit 1008. The power supplying unit 1008 charges the output end OUT according to a clock signal CLK. The clock signal CLK has periodical pulses to control the power supplying unit 1008 to periodically charge the output end. As a result, the power supplying module 1000 can utilize the power supplying unit 1008 to compensate the small voltage drops of the output voltage VOUT generated by non-ideal effects (e.g. the leakage current).

Figure 11:
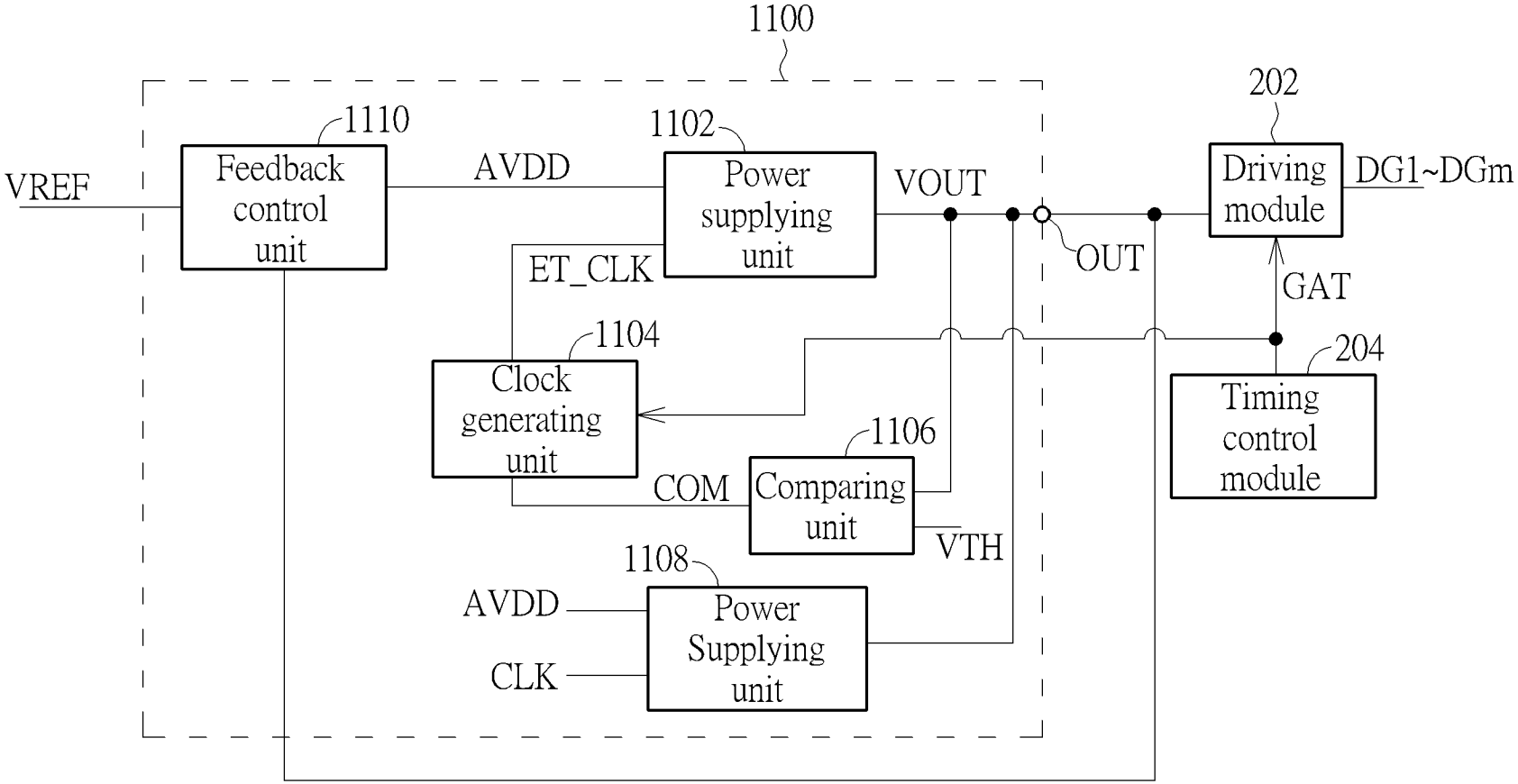
FIG. 11 is a schematic diagram of a power supplying module according to an example of the present invention.

Please refer to FIG. 11, which is a schematic diagram of a power supplying module 1100 according to an example of the present invention. The power supplying module 1100 is an implementation of the power supplying module 206 shown in FIG. 2. In addition, the power supplying module 1100 is similar to the power supplying module 1000, thus the components and signals with similar functions use the same symbols. Different from the power supplying module 1000, the power supplying module 1100 adds a feedback control unit 1110. The feedback control unit 1110 couples to the output end OUT and is utilized to adjust the voltage source AVDD according to the relationship between the output voltage VOUT and a reference voltage VREF. Via adding the feedback control unit 1110, the voltage source AVDD can be appropriately adjusted according to the output voltage VOUT.

To sum up, the power supply module of the above examples controls the power supplying unit to charge the output end when determining the events occurs (e.g. determining that the driving module coupled to the output end of the power supply module draws significant current or that the output voltage of the power supplying module become smaller than the threshold voltage). The power supplying module is capable of providing adequate driving ability to the driving module and the power consumption of the power supplying module is reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power supplying module for an electronic device with a display function, the power supply module comprising:

a first power supplying unit, for charging an output end according to a first clock signal, wherein the output end is coupled to a driving module of the electronic device; and a clock generating unit, for receiving a control signal instructing the driving module to draw the current from the output end and adjusting the first clock signal only when an event occurs to make the first power supplying unit charge the output end when the event occurs;

wherein the event comprises determining that the driving module draws current from the output end based on the control signal.

2. The power supplying module of claim 1, wherein the event comprises determining that an output voltage of the output end becomes smaller than a threshold voltage.

3. The power supplying module of claim 1, wherein the event comprises determining that the first power supplying unit does not charge the output end for a period.

4. The power supplying module of claim 1, further comprising:

a second power supplying unit, for periodically charging the output end according to a second clock signal.

5. A driving device for an electronic device with a display function, the driving device comprising:

a first power supplying unit, for charging an output end according to a first clock signal;

a driving module, coupled to the output end of the first power supplying unit for driving a display module of the electronic device; and a clock generating unit, for receiving a control signal instructing the driving module to draw the current from the output end and adjusting the first clock signal only when an event occurs to make the first power supplying unit charge the output end when the event occurs;

wherein the event is determining that the driving module draws current from the output end based on the control signal.

6. An electronic device, comprising:

a display module;

a power supplying module, comprising:

a first power supplying unit, for charging an output end according to a first clock signal; and a clock generating unit, for receiving a control signal instructing the driving module to draw the current from the output end and adjusting the first clock signal only when an event occurs to make the first power supplying unit charge the output end when the event occurs; and a driving module, coupled to the output end of the first power supplying unit for driving the display module;

wherein the event is determining that the driving module draws current from the output end based on the control signal.

7. A power supplying module for an electronic device with a display function, the power supply module comprising:

a first power supplying unit, for charging an output end according to a first clock signal, wherein the output end is coupled to a driving module of the electronic device; and a clock generating unit, for adjusting the first clock signal only when an event occurs to make the first power supplying unit charge the output end when the event occurs;

wherein the event is that an output voltage of the output end becomes smaller than a threshold voltage.

8. A power supplying module for an electronic device with a display function, the power supply module comprising:

a first power supplying unit, for charging an output end according to a first clock signal, wherein the output end is coupled to a driving module generating a plurality of driving signals in the electronic device; and a clock generating unit, for adjusting the first clock signal only when an event occurs to make the first power supplying unit charge the output end when the event occurs;

wherein the event is that the driving module adjusts one of the plurality of driving signals from a first logic level to a second logic level.

* * * * *